United States Patent [19]

Nieuwendijk et al.

[11] Patent Number: 4,847,908

[45] Date of Patent: Jul. 11, 1989

[54] LOUDSPEAKER HAVING A TWO-PART DIAPHRAGM FOR USE AS A CAR LOUDSPEAKER

[75] Inventors: Joris A. M. Nieuwendijk; Johannes W. T. Bax; Johannes J. M. Kamphues; Franciscus C. M. de Haas, all of Eindhoven, Netherlands

[73] Assignee: U.S. Philips Corp., New York, N.Y.

[21] Appl. No.: 101,876

[22] Filed: Sep. 28, 1987

[30] Foreign Application Priority Data

Sep. 29, 1986 [NL] Netherlands ..... 8602451

[51] Int. Cl.[4] ..... H04R 9/06

[52] U.S. Cl. ..... 381/202; 381/193; 181/163; 181/165; 181/170; 181/172; 181/174; 181/166

[58] Field of Search ..... 181/163, 164, 165, 166, 181/170, 172, 173, 174, 171; 381/202, 203, 204, 193, 182, 184, 186

[56] References Cited

U.S. PATENT DOCUMENTS 2,863,520 12/1958 Manley et al. ..... 181/171 X
4,057,694 11/1977 Obuchi ..... 381/202 X

FOREIGN PATENT DOCUMENTS 3123098 1/1983 Fed. Rep. of Germany .
935222 8/1963 United Kingdom ..... 381/189

OTHER PUBLICATIONS

John Carter, "Digital Simulator for Automotive Sound System Design", Audio Systems Publication, 142, pp. 31-34, Feb. 1984.

Ludwig Klapproth, "Acoustic Characteristics of the Vehicle Environment", Preprint No. 2185 (C-3) of the 77th AES Convention in Hamburg, Mar. 1985.

*Primary Examiner*—L. T. Hix
*Assistant Examiner*—Brian W. Brown
*Attorney, Agent, or Firm*—Bernard Franzblau

[57] ABSTRACT

An electrodynamic loudspeaker (1) has a diaphragm comprising a central part (2) and a peripheral part (3), and a voice-coil device (9, 10) coupled to the central part (2). The surface ratio $S_2/S_1$ complies with the relationship $0.5 \leqq S_2/S_1 \leqq 6$, where $S_1$ and $S_2$ are the surface areas of the central part (2) and the peripheral part (3) respectively. The mass ratio $m_2/m_1$ complies with the relationship $0.5 \leqq m_2/m_1 \leqq 8$ where $m_1$ and $m_2$ are the mass of the central part (2) and the voice-coil device (9, 10) and the mass of the peripheral part (3) respectively. Further, the stiffness imposed on the diaphragm by the space (6, 6') defined by the diaphragm (2, 3) and the chassis (4) and/or the magnet system (7) is smaller than the stiffness of the diaphragm itself. Thus it is possible to derive a car loudspeaker which has a specific dip in its frequency response characteristic P (FIG. 2*a*), measured in an anechoic room.

18 Claims, 3 Drawing Sheets

LOUDSPEAKER HAVING A TWO-PART DIAPHRAGM FOR USE AS A CAR LOUDSPEAKER

BACKGROUND OF THE INVENTION

It is known that a loudspeaker having a flat frequency characteristic (i.e. a characteristic in which the sound pressure level P is given as a function of the frequency with a constant input voltage on the loudspeaker), when mounted in a car, yields a non-flat frequency response, which is undesirable.

This problem is set forth in John Carter's publication entitled "Digital simulator for automotive sound system design", *Audio Systems* P-142, page 31, published by the Society of Automotive Engineers, February 1984.

FIG. 1 in the above publication gives an example of such a frequency response characteristic in a car. The curve shown therein exhibits a hump at frequencies between approximately 200 and 400 Hz.

In order to realise nevertheless a flat frequency response characteristic in the car, said publication proposes the use of a frequency equalizer which must therefore be adjusted to provide frequency response characteristic which is substantially the inverse of the frequency response characteristic of the loudspeaker in the car.

The publication "Acoustic characteristics of the vehicle environment" by L. Klapproth, preprint No. 2185 (C-3) of the 77th AES Convention in Hamburg of March 1985, shows response characteristics measured in different types of cars and measured at different locations in a car. The author states that the sound in the test cars is boosted by approximately 10 dB in the frequency range from approximately 100 to 400 Hz. This means that in general the frequency equalizer must have a frequency characteristic which exhibits a broadened dip of 5 to 10 dB in the frequency range having a lower limit-frequency lying somewhere between 100 and 200 Hz and having an upper limit frequency lying somewhere between 400 and 500 Hz.

It is an object of the invention to provide a loudspeaker having a frequency characteristic which inherently exhibits a (broadened) dip. Moreover, it is an object of the invention to propose additional steps enabling the loudspeaker to be dimensioned in such a way that the dip has the desired depth of 5 to 10 dB and is situated in a desired frequency range (measured in an anechoic room) so that a separate equalizer is not needed in order to obtain a flat frequency response characteristic in the car. It is a further object to provide a loudspeaker having a broadened dip (preferably 5–10 db) in the low frequency range of its frequency characteristic, e.g. in the frequency range of 100 Hz to 500 Hz.

The invention is applied to a loudspeaker of a construction as disclosed in German Pat. Specification No. 3,123,098. This known transducer comprises a diaphragm, a chassis, a magnet system coupled to the chassis, and a voice coil device coupled to the diaphragm, The voice-coil device is situated in an air gap defined by the magnet system, The diaphragm comprises a central part and a surrounding peripheral part which is coupled to the chassis along its outer circumference, the stiffness of the central part being higher than that of the peripheral part, and the voice-coil device being coupled to the central part, the ratio $S_2/S_1$ complying with:

$$x_1 \leqq S_2/S_1$$

where $x_1$ is a specific value and $S_1$ and $S_2$ are the surface areas of the central part and the peripheral part respectively. However, the known transducer is intended to provide a flat frequency characteristic.

In a previously filed copending U.S. patent application No. 872,057, filed June 6, 1986, a loudspeaker of the same construction is described in which the ratio $S_2/S_1$ complies with:

$$x_1 \leqq S_2/S_1 \leqq x_2,$$

where $x_1$ and $X_2$ are a specific first and second value respectively, and $S_1$ and $S_2$ are the surface areas of the central part and the peripheral part respectively, and in which the ratio $m_2/m_1$ complies with:

$$x_3 \leqq m_2/m_1 \leqq x_4,$$

where $x_3$ and $x_4$ are a specific third and a specific fourth value respectively, and $m_1$ is the mass of the central part and the voice-coil device, and $m_2$ is the mass of the peripheral part. This loudspeaker is also intended to provide a flat frequency-response characteristic.

SUMMARY OF THE INVENTION

In order to obtain a frequency response characteristic with a broadened dip, the loudspeaker in accordance with the invention should be characterized in that the first value and the second value are equal to 0.5 and 6 respectively, the third value and the fourth value are equal to 0.5 and 8 respectively, and in that the stiffness imposed on the diaphragm by the space formed by the diaphragm and the magnet system and/or the chassis is smaller than the stifness of the diaphragm. In fact, the requirement that the stifness imposed on the diaphragm by the space formed by the diaphragm and the magnet system and/or the chassis be smaller than the stiffness of the diaphragm itself, means that the motion of the diaphragm should not be impeded by the air volume at the rear of the diaphragm. In other words: the air volume at the rear diaphragm should not or not significantly affect the frequency response characteristic of the loudspeaker. The stiffness of the diaphragm is defined as the force [in N], exerted on the voice-coil former in the direction of its excursion divided by the excursion of the voice-coil former [in m].

The above requirement can be met by making the air volume behind the diaphragm large enough, provided that it is a fully enclosed volume. However, this renders the loudspeaker rather bulky, which may be a disadvantage when it is to be used as a car loudspeaker.

Another possibility is to provide the magnet system and/or the chassis with at least one aperture in order to provide an acoustic path through the magnet system and/or the chassis of the transducer.

The invention is based on the recognition of the fact that during use of a loudspeaker having a two-part diaphragm, when the mechanical damping of the peripheral part is chosen correctly, the frequency response versus input impedance characteristic of the loudspeaker substantially exhibits only two maxima which correspond to the two resonant frequencies $f_1$ and $f_2$ for which the central part and the peripheral part vibrate in phase and in phase opposition relative to each other. The frequency response versus sound pressure characteristic of the loudspeaker will exhibit a dip in the curve at a frequency $f_d$ as a result of the resonance at the frequency $f_2$. At the frequency $f_d$ the contributions of the central part and the peripheral part to the acoustic output signal of the loudspeaker largely cancel one another because the two parts move in phase opposition to each other and produce substantially equal (yet opposite) acoustic contributions at this very frequency. Therefore, $f_d$ generally does not coincide with $f_2$.

Moreover, when the damping has been selected appropriately the desired depth of 5 to 10 dB of the dip can be obtained and the frequency response characteristic is otherwise reasonably flat, i.e. without additional peaks or dips as a result of higher-order modes in the peripheral part.

The radial stiffness of the peripheral part, if provided with corrugations which extend substantially parallel to the inner and the outer circumference of the peripheral part, or the mechanical pretension of the peripheral part if it take the form of a stretched foil, can then be selected in such a way that the dip will be situated in the desired frequency range.

The loudspeaker now operates in such a way that at low frequencies the central part and the peripheral part vibrate in phase with one another, so that a higher sound radiation at low frequencies can be obtained. At high frequencies it is mainly the central part which vibrates, so that also at high frequencies a satisfactory radiation characteristic can be achieved. In a specific central range between the high and the low frequencies the central part and the peripheral part counteract each other in a specific sense, so that in this range the (desired) dip in the frequency response characteristic is obtained.

The desired degree of damping of the peripheral part can be obtained if the peripheral part comprises a layer of a damping material. An example of this is a class-2 ball-bearing grease applied between two layers forming the peripheral part.

In order to comply with the formula for $m_2/m_1$ it may sometimes be necessary to increase to reduce the mass $m_2$ of the peripheral part. This may be achieved by mixing the ball-bearing grease with a material having a higher and a lower density, respectively. It is, for example, possible to add copper powder (to make the peripheral part heavier) or suitable hollow glass particles or granules of a plastics foam (to reduce the weight of the peripheral part). The weight of the central part may also be increased or reduced, as desired. Reducing the weight of the central part can be achieved, for example, by giving a portion of the central part situated within the voice coil or in line therewith a dome shape. A curved surface has a higher stiffness than a non-curved surface. This enables the thickness of the dome-shaped part to be reduced. Consequently, the weight of the central portion is reduced. Moreover, it is possible to vary voice coil diameters substantially by sealing the voice coils by means of a dome-shaped cap.

Another possibility is to couple the voice-coil device to the central part via an auxiliary cone. This also enables the weight of the central part to be reduced, namely in the case where the central part has an aperture having the size of the outer circumference of the auxiliary cone and the outer circumference of this auxiliary cone is coupled to the central part along the circumference of the aperture in the central part. In this case the auxiliary cone in fact also belongs to the central part. In determining the magnitude of the surface area $S_1$ of the central part in embodiments where the central part is (partly or wholly) dome shaped or conical, allowance should be made for the fact that $S_1$ denotes the magnitude of the surface area of the projection of the central part in a plane perpendicular to the axis of the voice-coil device. It is obvious that the same applies to $S_2$ if the peripheral part is not flat.

BRIEF DESCRIPTION OF THE DRAWINGS

Embodiments of the invention will now be described in more detail, by way of example, with reference to the accompanying drawings. Parts in different Figures bearing the same reference numerals are identical. In the drawings.

DESCRIPTION OF THE PREFERRED EMBODIMENTS

Figure 1:
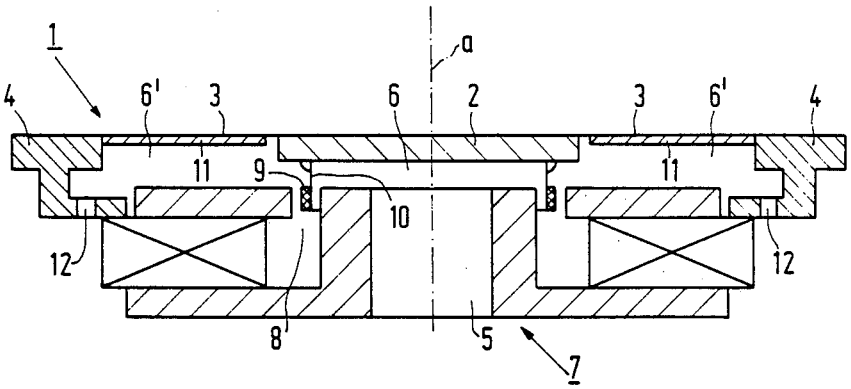
FIG. 1 is a sectional view of the loudspeaker in accordance with the invention.

FIG. 1 is a sectional view taken on the axis a of a circular loudspeaker 1 having a diaphragm comprising a central part 2 surrounded by a peripheral part 3. As stated, the loudspeaker is circular, but alternatively it may have a different shape, for example rectangular or oval. At its outer circumference the diaphragm is secured to the chassis 4 of the transducer. The central part 2 and the magnet system 7 bound a space 6 which communicates with the surrounding medium via a duct 5 in the central core. The diaphragm with the magnet system 7 and chassis 4 further bound a space 6' which also communicates with the surrounding medium via ducts 12 formed in the chassis 4.

The said magnet system 7 is of a conventional construction and requires no further explanation. The voice coil 9 is arranged in the air gap 8 defined by the magnet system 7 and is coupled to the central part 2 via the voice coil former 10.

The central part 2 has a higher stiffness than the peripheral part 3. The central part may be made of a hard plastics, for example, a polymethacrylimide foam. The peripheral part 3 is mechanically pretensioned and has substantially no resistance to bending. The peripheral part 3 may be made of, for example, a thin plastics foil, for example Kapton (Trade Name), and be coated with a damping layer 11. However, this damping layer should not or, at the most, not significantly contribute to the resistance to bending of the peripheral part 3. The surface area $S_1$ of the central part 2 and the surface area $S_2$ of the peripheral part 3 comply with the following relationship:

$$0.5 \leqq S_2/S_1 \leqq 6 \quad (1)$$

Further, the ratio $m_2/m_1$, where $m_1$ is the mass of the central part 2 and the voice-coil device 9, 10, and $m_2$ is the mass of the peripheral part 3 including the damping layer 11 if, present, comply with the following relationship:

$$0.5 \leqq m_2/m_1 \leqq 8 \quad (2)$$

Instead of constructing the peripheral part as a clamped-in foil, the peripheral part may be constructed as a corrected peripheral part, i.e. provided with corrugations which extend parallel to the inner and the outer circumference of the peripheral part. In that case the radial resistance to bending is essential. There is no mechanical pretension.

The ducts 5 and 12, which should be of adequate cross-section to avoid a high air resistance and to avoid coupling of cavities, are formed in the magnet system 7 and the chassis 4, respectively in order to ensure that the stifness imposed on the diaphragm by the spaces 6 and 6' is smaller than the stifness of the diaphragm 2, 3 itself. This means that the spaces 6, 6' do (should) not affect the motion of the diaphragm 2, 3. The embodiment shown in FIG. 1 may result in a very flat loudspeaker.

The ducts 5 and 12 may also be dispensed with. In order to meet the requirement that the stifness of the space 6, 6' is then lower than that of the diaphragm, the spaces 6 and 6' would have to be increased to a considerable extent, resulting in a far more bulky loudspeaker.

Figure 2A:
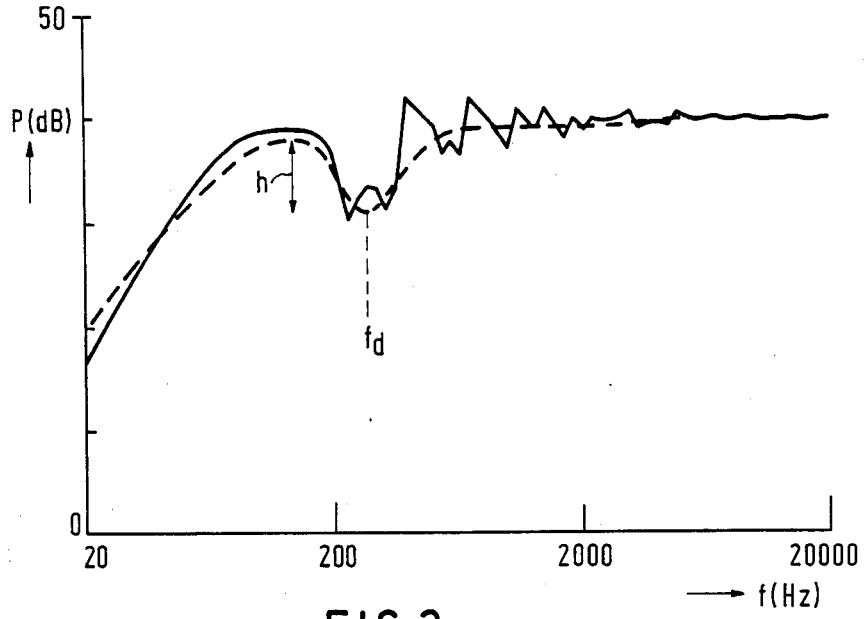
FIG. 2*a* is a frequency response versus sound pressure characteristic of the loudspeaker of FIG. 1.
Figure 2B:
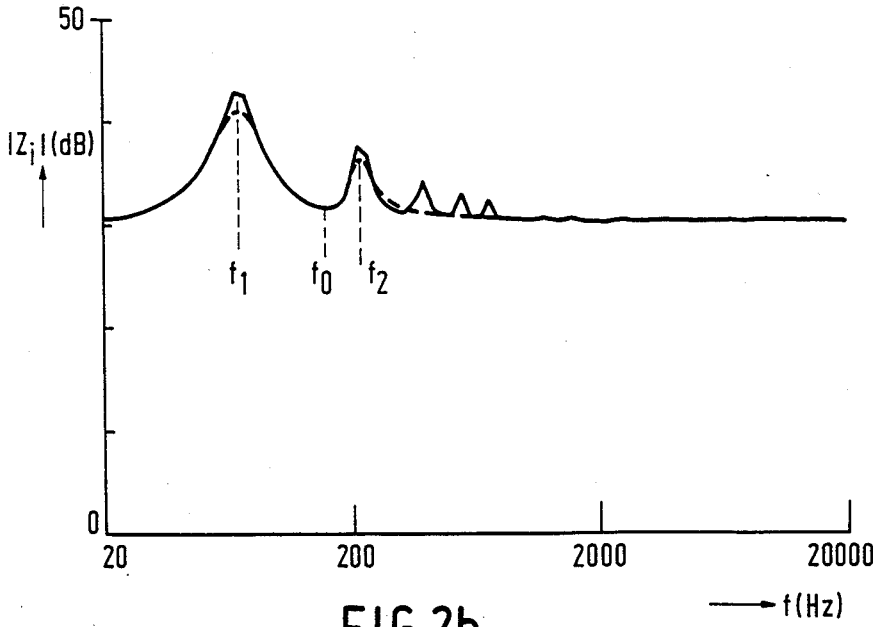
FIG. 2*b* is a frequency response versus electrical input impedance characteristic of the loudspeaker of FIG. 1, FIGS. 3*a* and 3*b* illustrate vibration modes of the diaphragm for which the central part and the peripheral part move in phase and phase opposition relative to each other, respectively.

The behavior of the loudspeaker shown in FIG. 1, which complies with formulas (1) and (2), will now be further described with reference to FIG. 2. Fig. 2*a* shows the on-axis sound pressure P as a function of the frequency, the loudspeaker being incorporated in a battle and being driven with a constant input voltage, and FIG. 2*b* gives the electrical input impedance of the loudspeaker as a function of the frequency. The curves have been obtained by computations on a computer model of the loudspeaker of FIG. 1, the value taken for the damping of the peripheral part being selected too low, as will become apparent hereinafter and the value taken for the mechanical pretension of the peripheral portion being selected correctly.

Figure 3A:
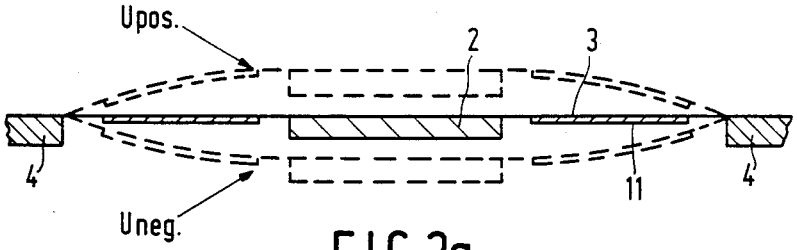
Figure 3B:
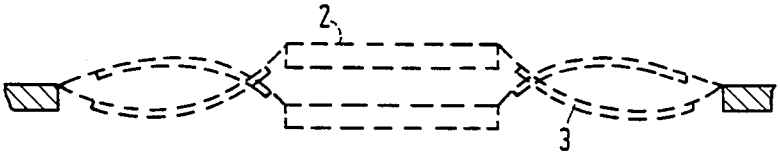

The impedance curve $Z_i$ in FIG. 2*b* exhibits a number of maxima corresponding to resonances of the diaphragm 2, 3. The frequency $f_1$ corresponds to that resonance of the diaphragm for which the central part 2 and the peripheral part 3 vibrate in phase, whereas $f_2$ corresponds to a situation in which the central part 2 and the peripheral part 3 are out of phase relative to one another. The two vibration modes corresponding to these resonant frequencies $f_1$ and $f_2$ are given in FIG. 3*a* and 3*b*. FIG. 3*a* shows the vibration mode at a frequency $f_1$ for which the central part 2 and the peripheral part 3 move in phase with each other. The maximum excursion of the diaphragm in one direction, the positive direction is indicated by the dashed outline $u_{pos}$ of the diaphragm and the maximum excursion of the diaphragm in the other or negative direction is indicated by the dashed outline $u_{neg}$ of the diaphragm. From FIG. 3*a* it is evident that the central part 2 and the peripheral part 3 move in phase with each other. FIG. 3*b* shows the vibration mode at the frequency $f_2$ for which the central part 2 and the peripheral part 3 move in phase opposition to one another. This is evident because if the central part 2 has an excursion in the one or the positive direction, the peripheral part 3 largely has an excursion in the other or the negative direction, and vice versa. Moving in phase opposition to each other means that the two parts of the diaphragm are 180° out of phase relative to each other. The maxima at higher frequencies in the curve $Z_i$ in FIG. 2*b* corresponds to higher-order vibration modes of the diaphragm, mainly vibration modes in the peripheral part 3.

The sound-pressure curve of FIG., 2*a* has an irregular shape as a result of the vibration modes in the diaphragm. For example, the dip in the curve P at the frequency $f_d$ results from the resonance at the frequency $f_2$. At this frequency $f_d$ the contributions of the central part and the peripheral part to the acoustic output of the transducer largely cancel one another because of the fact that the two parts vibrate in phase opposition relative to one another and therefore furnish substantially equal (but opposite) acoustic contributions. Therefore, it is not surprising that the dip in the curve of FIG. 2*a* at $f_d$ does not coincide with the peak in FIG. 2*b* at $f_2$. Peaks and dips as a result of higher-order modes of the peripheral part at frequencies above $f_d$ occur as a result of the inadequate damping of the peripheral part. They manifest themselves as distortion and are therefore undesirable.

The mechanical damping of th peripheral part 3 should be selected in such a way that in the characteristic of the frequency response versus the electrical input impedance $Z_i$ of the transducer shown in FIG. 1 only two maxima occur, which correspond to the two resonant frequencies for which the central part and the peripheral part 3 move in phase and in phase opposition relative to one another, as will be explained with referece to FIG. 3. Therefore the dip will have the desired depth of 5 to 10 dB. By selecting a correct, hence slightly higher, damping, the broken-line curve in FIG. 2*b* is obtained. In FIG. 2*a* this also results in a smoother curve, as indicated by the broken line. In FIG. 2*a* the dip in a frequency range just above 200 Hz is clearly visible. In the case of an excessive damping a substantial efficiency loss will occur, which is also undesirable. For this high damping the two peaks corresponding to said two principal modes, for which the two parts of the diaphragms vibrate in phase and in phase opposition relative to each other, will become very broad and it is no longer possible to recognize one or both peaks.

The desired damping can be obtained by means of the damping layer 11, for example a rubber layer. Another possibility is to arrange, either alternatively or in addition, a damping material, for example glass wool, the enclosed volume 6 and/or 6' behind the diaphragm.

The exact location of the dip in FIG. 2*a* can be influenced by varying the magnitude of the mechanical pretension in the diaphragm. The mechanical pretension will therefore be adjusted in such a way that the dip is situated in a frequency range between 100 and 500 Hz, as is necessary for use as a car loudspeaker. The same applies to the case where the diaphragm is not mechanically pretensioned but exhibits a radial resistance to bending. In that case the magnitude of the radial stiffness dictates the location of the dip.

The electrical damping is preferably selected in such a way that the electrical quality factor $Q_e$ at $f_o$ complies with $$0.5 \leqq Q_e \leqq 1.5 \quad (3)$$

where $Q_e$ can be derived from $$Q_e = \frac{m_1 2\pi f_o R_e}{B^2 l^2} \quad (4)$$

in which $R_e$ is the d.c. resistance of the voice coil 9,

B1 is the B1 product of the magnet system 7, and $f_o$ is the value of the antiresonance frequency, see FIG. 2*b*. The anti-resonance frequency $f_o$ indicates the location of the minimum in the impedance curve of FIG. 2*b* between the resonant frequencies $f_1$ and $f_2$. At the anti-resonance frequency $f_o$ the two parts of the diaphragm are 90° out of phase relative to each other.

The requirement of formula (3) is customary in electro-acoustic transducers.

Figure 4:
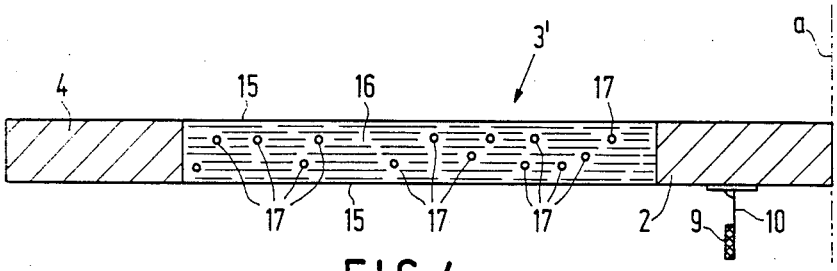
FIG. 4 shows a part of the loudspeaker of FIG. 1 in which the peripheral part is of a different construction.

FIG. 4 shows a part of another embodiment in which the damping of the peripheral part is realised in a different way. Here the peripheral part 3 comprises a laminate of two foils 15, for example two Kapton foils, between which a damping material 16, for example in the form of a class 2 ball-bearing grease, is interposed. Should the mass $m_2$ of the peripheral part 3 be such that formula (2) cannot be satisfied, it is possible to mix the ball-bearing grease 16 with heavier or, conversely, lighter particles 17. Examples of these are copper particles and hollow glass spheres or foam plastics granules.

Figure 5:
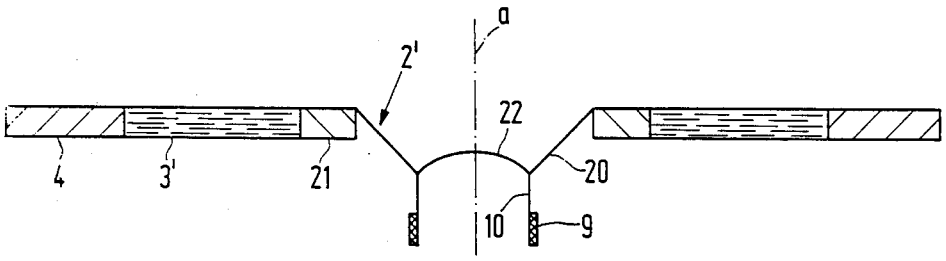
FIG. 5 shows a diaphragm of another embodiment of the loudspeaker in accordance with the invention.
Figure 6:
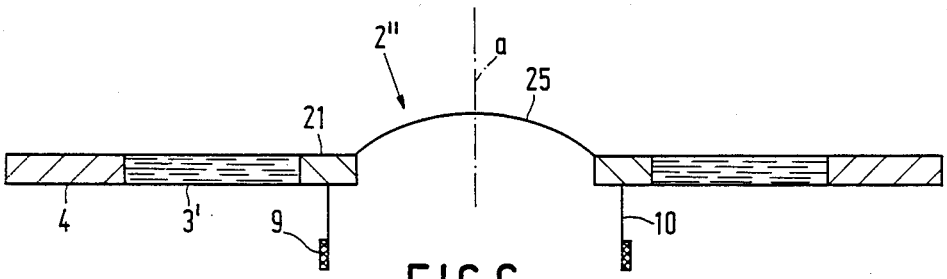
FIG. 6 shows a diaphragm of yet another embodiment.

FIGS. 5 and 6 show embodiments in which the central part is of a different construction. FIG. 5 shows a central part 2' in the form of an auxilliary cone and a portion 21. The cone 20 connects the voice-coil device 9, 10 to the central portion 21, whose outer circumference has the same shape as the outer circumference of the central part 2'. The voicecoil former 10 is sealed by means of a dust cap 22. The embodiment shown in FIG. 5 enables the mass of the central part to be reduced in comparison with that in the embodiment shown in FIG. 1. The same applies to the embodiment shown in FIG. 6, where the central part 2'' comprises the dome-shaped portion 25 and the portion 21.

It is to be noted that in the embodiments of FIGS. 5 and 6 the surface area $S_1$ of the central part 2' and 2'' respectively corresponds to the projection of the surface area of the central part in a plane perpendicular to the axis a.

Figure 7:
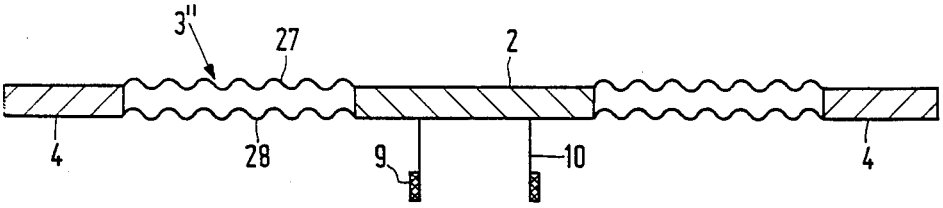
FIG. 7 shows a diaphragm of still another embodiment.

FIG. 7 shows yet another embodiment in which the peripheral part is of a different construction. FIG. 7 shows a peripheral part 3'' of a compliant flexible material formed with corrugations which extend over the surface of the peripheral part substantially parallel to the inner and the outer circumference of the peripheral part 3''. The peripheral part may be constructed in one piece. Alternatively, it is possible, as is shown in FIG. 7, to construct the peripheral portion from two corrugated layers 27 and 28 between which a damping material, for example said ball-bearing grease, may be sandwiched.

If the peripheral part is made in one piece (i.e. comprises one layer), it is possible to provide a damping material, for example, a polyurethane paste, between the corrugations on the peripheral part (not shown).

Preferably, the number of corrugations is comparatively large. In transducers of normal dimensions 5 or more corrugations are preferred. In the present embodiment the location of the dip in FIG. 2*a* can be influenced by varying the radical resistance to bending of the peripheral part 3'' which means that this resistance to bending should be such that the dip is located in the frequency range between 100 and 500 Hz.

It is to be noted that various modifications of the embodiments shown are possible without departing from the protective scope as defined in the appended Claims.

What is claimed is:

1. An electrodynamic loudspeaker providing a broadened dip in a low frequency range of its frequency characteristic comprising a diaphragm, a chassis, a magnet system coupled to the chassis, and a voice-coil device coupled to the diaphragm and situated in an air gap defined by the magnet system, the diaphragm comprising a central part and a surrounding peripheral part which is coupled to the chassis along its outer circumference, the stiffness of the central part being higher than that of the peripheral part and the voice-coil device being coupled to the central part, the ratio $S_2/S_1$ complying with:

$$0.5 \leqq S_2/S_1 \leqq 6,$$

where $S_1$ and $S_2$ are the surface areas of the diaphragm central part and the peripheral part respectively, and in which the ratio $m_2/m_1$ complies with:

$$0.5 \leqq m_2/m_1 \leqq 8,$$

where $m_1$ is the mass of the diaphragm central part and the voice-coil device, and $m_2$ is the mass of the peripheral part, wherein the stiffness imposed on the diaphragm by a space formed by the diaphragm and the magnet system and/or the chassis is smaller than the stiffness of the diaphragm whereby the loudspeaker exhibits a frequency characteristic having a broadened dip in the low frequency range of its frequency characteristic.

2. An electrodynamic loudspeaker as claimed in Claim 1, wherein the magnet system and/or the chassis includes at least one aperture to provide an acoustic path through the magnet system and/or the chassis of the loudspeaker.

3. An electrodynamic loudspeaker as claimed in Claim 2, wherein the diaphragm peripheral portion is mechanically pretensioned so as to provide a 5–10 db dip in the frequency response characteristic of the loudspeaker in a frequency range between 100 Hz and 500 Hz.

4. An electrodynamic loudspeaker as claimed in Claim 2, wherein the diaphragm peripheral part includes corrugations which extend substantially parallel to the inner and the outer circumference of the peripheral part.

5. An electrodynamic loudspeaker as claimed in claim 1 wherein the voice-coil device is coupled to the central part via an auxiliary cone.

6. An electrodynamic loudspeaker as claimed in claim 1 wherein a portion of the diaphragm central part situated within the voice-coil device or in line therewith is dome-shaped.

7. An electrodynamic loudspeaker as claimed in claim 1 wherein the diaphragm peripheral portion is mechanically pretensioned so as to provide said broadened dip in the loudspeaker frequency characteristic in the frequency range of 100 Hz to 500 Hz.

8. An electrodynamic loudspeaker as claimed in claim 1 wherein the peripheral part of the diaphragm includes corrugations which extend substantially parallel to the inner and the outer circumference of the peripheral part and selected so that said dip in the frequency characteristic occurs in a frequency range between 100 Hz and 500 Hz.

9. An electrodynamic loudspeaker comprising: a chassis, a magnet system coupled to the chassis, a voice-coil device located in an air gap defined in the magnet system, and a two-part diaphragm comprising a central part coupled to the voice-coil device and a surrounding peripheral part having an outer circumference coupled to the chassis, wherein the stiffness of the central part is greater than that of the peripheral part and the surface ratio $S_2/S_1$ lies in the range of 0.5 to 6, where $S_1$ and $S_2$ are the surface areas of the central part and the peripheral part, respectively, wherein the parts of the diaphragm have a ratio $m_2/m_1$ which lies in the range of 0.5 to 8, where $m_1$ is the mass of the central part and the voice-coil device and $m_2$ is the mass of the peripheral part, and wherein the diaphragm and the magnet system and/or the chassis define a space that imposes a stiffness on the diaphragm that is less than the stiffness of the diaphragm alone whereby the loudspeaker has a frequency response characteristic with a broadened dip in the low frequency range of said frequency characteristic.

10. A electrodynamic loudspeaker as claimed in claim 9 wherein the peripheral part of the diaphragm includes a damping material selected to provide a 5–10 db dip in the frequency response characteristic of the loudspeaker in the frequency range between 100 Hz and 500 Hz.

11. An electrodynamic loudspeaker as claimed in claim 9 wherein the peripheral part of the diaphragm is provided with mechanical damping selected so that the frequency versus input impedance characteristic of the loudspeaker in a frequency range between 100 Hz and 500 Hz substantially exhibits only two maxima corresponding to first and second resonant frequencies for which the central part and the peripheral part vibrate in phase and in phase opposition, respectively, relative to one another.

12. An electrodynamic loudspeaker as claimed in claim 9 wherein the magnet system and/or the chassis include at least one aperture to provide an acoustic path, and wherein the parameters of the loudspeaker are chosen so that the loudspeaker has a 5–10 db dip in its frequency response characteristic in a frequency range between approximately 100 Hz and 500 Hz, whereby the loudspeaker is especially adapted for use as an automobile loudspeaker.

13. An electrodynamic loudspeaker as claimed in claim 9 wherein the diaphragm comprises a thin flat plastic material, the peripheral part is mechanically pretensioned and has substantially no resistance to bending, the chassis includes at least one duct located to allow a space behind the peripheral part of the diaphragm to communicate with outside air surrounding the loudspeaker.

14. An electrodynamic loudspeaker comprising: a diaphragm, a chassis, a magnet system coupled to the chassis and a voice-coil device coupled to the diaphragm and situated in an air gap defined by the magnet system, the diaphragm comprising a central part and a surrounding peripheral part which is coupled to the chassis along its outer circumference, the stiffness of the central part being higher than that of the peripheral part and the voice-coil device being coupled to the central part, the ratio $S_2/S_1$ complying with:

$$0.5 \leqq S_2/S_1 \leqq 6,$$

where $S_1$ and $S_2$ are the surface areas of the diaphragm central part and the peripheral part respectively, and in which the ratio $m_2/m_1$ complies with:

$$0.5 \leqq m_2/m_1 \leqq 8,$$

where $m_1$ is the mass of the diaphragm central part and the voice-coil device, and $m_2$ is the mass of the peripheral part, wherein the stiffness imposed on the diaphragm by a space formed by the diaphragm and the magnet system and/or the chassis is smaller than the stiffness of the diaphragm, and wherein the mechanical damping of the peripheral part is selected so that the frequency response versus input impedance characteristic of the loudspeaker substantially exhibits only two maxima corresponding to two resonant frequencies for which the central part and the peripheral part vibrate in phase and in phase opposition relative to one another.

15. An electrodynamic loudspeaker as claimed in claim 14, wherein the peripheral part comprises a layer of damping material.

16. An electrodynamic loudspeaker as claimed in claim 15, wherein the damping material is a class-2 ball-bearing grease interposed between to layers forming the peripheral part.

17. An electrodynamic loudspeaker as claimed in Claim 16, wherein the ball-bearing grease is mixed with a material having a higher density than the ball-bearing grease.

18. An electrodynamic loudspeaker as claimed in Claim 16, wherein the ball-bearing grease is mixed with a material having a lower density than the ball-bearing grease.

* * * * *